United States Patent [19]

Ploch et al.

[11] Patent Number: 4,554,804

[45] Date of Patent: Nov. 26, 1985

[54] APPARATUS AND METHOD FOR THE PRODUCTION OF TEXTILE SURFACE CONFIGURATIONS

[75] Inventors: Siegfrid Ploch; Sonja Rössler; Peter Zeisberg; Horst Heilmann, all of Karl-Marx-Stadt, German Democratic Rep.

[73] Assignee: VEB Kombinat Textima, Karl-Marx-Stadt, German Democratic Rep.

[21] Appl. No.: 455,691

[22] Filed: Jan. 5, 1983

[30] Foreign Application Priority Data

Jan. 25, 1982 [DD] German Democratic Rep. ... 236926

[51] Int. Cl.[4] ..... D04B 27/02

[52] U.S. Cl. ..... 66/214; 66/84 A; 66/104; 66/109

[58] Field of Search ..... 66/84 A, 85 A, 214, 66/104, 109, 190, 191, 192

[56] References Cited

U.S. PATENT DOCUMENTS

| | | | |
|---|---|---|---|
| Re. 28,718 | 2/1976 | Ehrlich et al. | 66/192 |
| 2,890,579 | 6/1959 | Mauersberger | 66/85 A |
| 3,603,114 | 9/1971 | Kandler et al. | 66/85 A |
| 3,611,754 | 10/1971 | Ehrlich et al. | 66/192 |
| 3,991,593 | 11/1976 | Bernert et al. | 66/85 A |
| 4,158,292 | 6/1979 | Ehedy et al. | 66/190 |
| 4,197,723 | 4/1980 | Ehedy et al. | 66/192 |

FOREIGN PATENT DOCUMENTS

| | | | |
|---|---|---|---|
| 2077785 | 12/1981 | United Kingdom | 66/85 A |

*Primary Examiner*—Ronald Feldbaum
*Attorney, Agent, or Firm*—Jordan and Hamburg

[57] ABSTRACT

The invention relates to an apparatus and a method for the production of textile surface configurations. The invention is on chain stitching or needle stitching machines for the production of clothing, decorative and household textiles, as well as for technical textiles. The object of the invention is achieved in that a flat guiding element has a contact edge on the side facing the fleece to be bound, and has at least one guiding hole or an eyelet or the kind for the guidance of the thread. The guiding element is movable and can have different shapes.

12 Claims, 12 Drawing Figures

APPARATUS AND METHOD FOR THE PRODUCTION OF TEXTILE SURFACE CONFIGURATIONS

BACKGROUND OF THE INVENTION AND PRIOR ART STATEMENT

The invention relates to an apparatus and a method for the production of textile surface configurations on chain stitching machines, particularly needle stitching machines, in which the textile surface configuration comprises a fibrous base material into which chain threads are bound by means of pointed hook needles, closable via a sliding device.

A needle stitching machine for the production of textile surface configurations is already known in which the surface configuration comprises a fleece and sewn or stitched threads (DD-PS No. 76,571). For this purpose, the needle stitching machine has pointed hook needles, closable via a sliding device, and operating together with hole needles. For the guidance or support of the fibrous base material when piercing it with the hook needles, the machine has a bracing bar in front, studded with pins, and a knock-off comb in the rear. A contact point for the fibrous material is located under the hook needles between the knock-off comb and the bracing bar.

It is the goal of the previously-known apparatus to bring part of the fleece into the stitches in order to prevent runs.

However, the previously-known apparatus and method do not permit streamlining of the process steps or of the elements of the apparatus so that there is more room in the stitching area for the arrangement of additional devices for inspection purposes.

It is the object of the invention to create an apparatus, the structural design of which is simpler than the previously-known ones, and which offers the possibility of forming run-resistant stitches of fibers as well as of threads, to enable a strong bond to be formed between virtually all fibers and to obtain high utilization value characteristics of the consequently-produced final product. The final product is a thread-reinforced, stitched material, being relatively light, and with textile characteristics suitable for use in clothing, decorative materials, home textiles, and textiles for the medical field or for technical products.

SUMMARY OF THE INVENTION

The apparatus of the invention makes it possible to assure the process steps—guiding and placing of a thread and retaining and insertion of fibers of a fleece-while using only one element of the apparatus.

The guiding element in the invention is previously known in similar chain stitching machines, being constructed in such a way that the hook- or sliding needles can pierce between two such guiding elements. The guiding element is in a position to retain the fibers of the fleece to be worked on when the sliding needles move forward so that the hook is free to receive a sewing thread. The sewing thread is placed into the hook and during this movement the guiding element makes room for the fleece so that the fleece can expand and be included into the piercing by the hook of the sliding needle. The fibers of the fleece as well as the sewing thread are now resting in the hook. Here, they are formed into stitches and, as already known, released in the form of long stitches. In order to guide the grasping of the fibers of the fleece, these can also be inserted into the hooks of the needles by the guiding elements. For the execution of these steps, the guiding elements have vertical edges, or possibly indentations or bevels, and loops or holes for the guidance of the threads. The guiding elements are usually constructed in one piece. However, a two-piece construction is possible, in which one piece accomplishes the insertion of the fibers of the fleece; the other the insertion of the threads. The single-piece part as well as the multiple-piece guiding elements perform a raising-lowering movement with their leading edges, at the same time as a movement is made to produce various thread combinations, such as fringes, tricot, cloth, filling, atlas and combinations of these. The arrangement of the guiding elements on two or more tracks is also possible.

By using the apparatus according to the invention, the fiber fleece is almost completely, and the threads are completely, worked up into stitches, and both stitch-forming elements, fibers and threads, are grasped simultaneously by the hooks of the sliding needles and formed into stitches. Depending on the thread guidance, the formed stitches comprise fibers and at least one thread, or fibers and threads, and fibers or threads. These stitches of various compositions can be arranged next to and/or superimposed on each other, according to a pattern. When choosing suitable threads and fibers, the required characteristics concerning run resistance, tenacity and stretchability, as well as a strong binding of the fibers of the fiber fleece, are assured, so that, for example, raised style processes are possible and stable napped blankets can be produced as well as stable fleece products to be used in the medical field, all at high production speed during all processing steps.

BRIEF DESCRIPTION OF THE DRAWINGS

FIG. 1 illustrates the arrangement of the guiding element in the stitching area, according to the invention;

FIGS. 2–6 illustrate various positions of the guiding element, according to the invention;

FIG. 7 illustrates possible movements of the guiding element in the direction of the longitudinal axis of the needle; and FIGS. 8–12 illustrate various embodiments of the guiding elements.

DETAILED DESCRIPTION OF PREFERRED EMBODIMENTS

The following is a glossary of terms and phrases, and elements and members, employed in the present specification.

GLOSSARY

Figure 1:
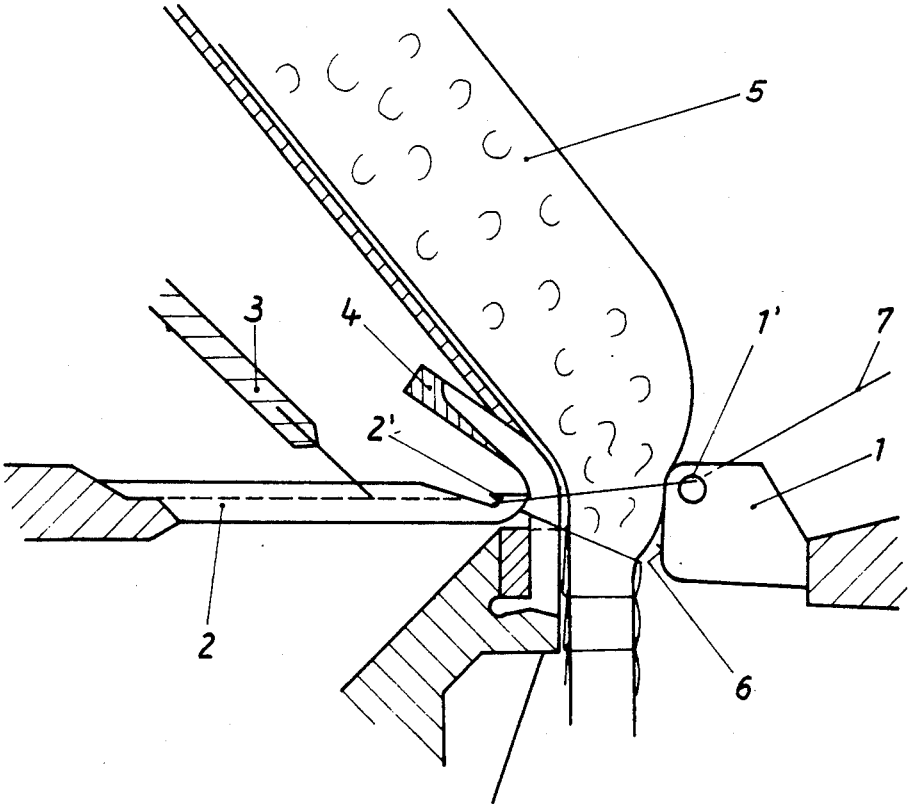
FIGS. 1–8 illustrate an embodiment of the invention. In the Drawings
Figure 2:
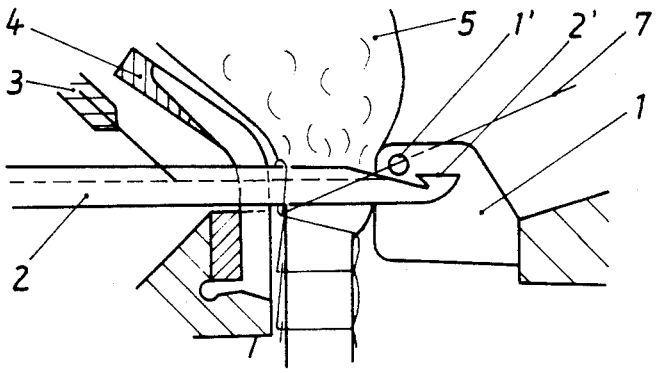

1. Guiding element
1'. Guiding hole
2. Sliding needle
2'. Hooks of the sliding needle
3. Closing wire
4. Knock-off plate
5. Fleece
6. Contact edge of the guiding element
7. Thread
8. Long stitches
9. Fixed tongue 10. Pivotal tongue 11. Staggered contact edge 12. Wavy contact edge Guiding elements 1, according to the invention, are combined into groups of 25 mm width and arranged according to FIG. 1. The stitching zone thus comprises guiding element 1, sliding needles 2, closing wire 3 and knock-off plate 4. An operating cycle runs as follows:

Sliding needles 2 enter from the posterior dead center, continue between the two knock-off plates 4 and reach fleece 5. Fleece 5 resists penetration of sliding needles 2 and tries to avoid them. The fleece is postioned against contact edge 6 of guiding element 1 and is thus prevented from continued elusive movements. Sliding needles 2 now have the opportunity to pierce fleece 5 and hooks 2' of sliding needles 2 are free to receive thread 7, which is guided through guide hole 1' of guiding element 1. (FIG. 2).

Figure 3:
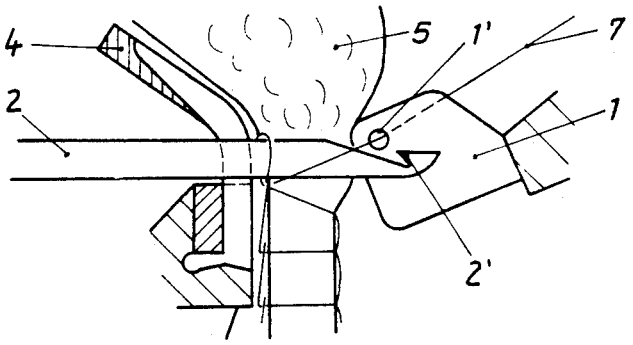
Figure 4:
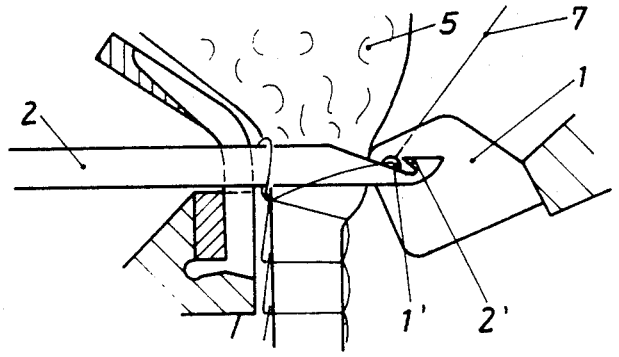

FIG. 3 illustrates guiding element 1 in its downward movement, inserting thread 7 into hook 2' of sliding needles 2, enabling the hook to grasp thread 7 (FIG. 4).

Figure 5:
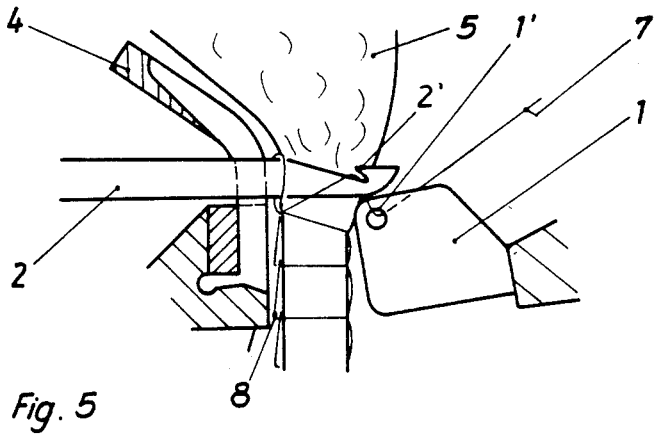
Figure 6:
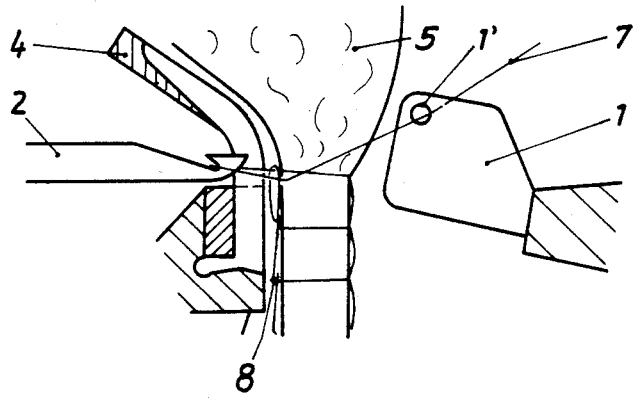

Guiding element 1 now swings in a downward direction, far enough so that fleece 5 can expand and the fibers of fleece 5 can be grasped by hooks 2' of sliding needles 2 (FIG. 5). Sliding needles 2 are now already on their way back, pulling with them the grasped fibers of fleece 5 as well as grapsed thread 7, making a combined stitch of both and depositing them as long stitches 8 on the left side of the goods. Sliding needles 2 have now finished their reverse motion, compressing fleece 5. (FIG. 6). Guiding elements 1 now return to their original position or perform a motion diagonal to the longitudinal axis of the sliding needle, in accordance with the set combination. According to the respective pattern, stitches comprising fibers from fleece 5 and threads 7, and others comprising only fibers from fleece 5 or threads 7, can be produced. It is further possible to move fleece 5 one or more needle divisions, analogous to the movement of the threads. Thereafter, the operational process starts from the beginning again.

Figure 7:
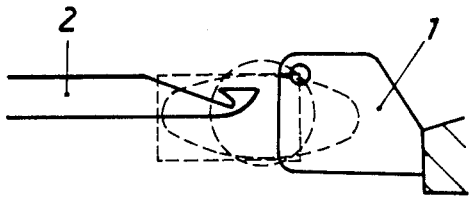
Figure 8:
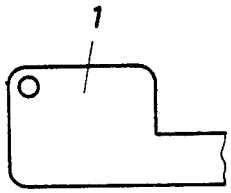
Figure 9:
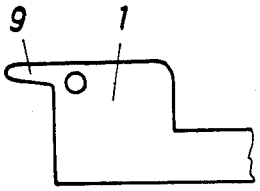
Figure 10:
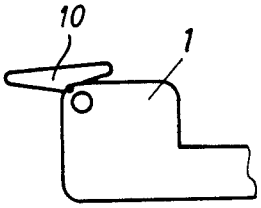
Figure 11:
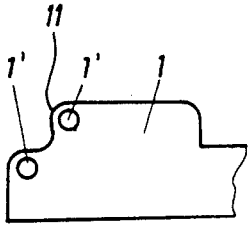
Figure 12:
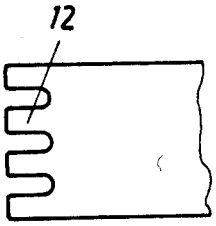

The invention further provides for guiding elements 1 to perform circular, elliptical or rectangular motions in the direction of the longitudinal axis of the needle (FIG. 7). The insertion of the fibers of fleece 5 into needle hook 2' can be supported by previously-known special devices. However, according to the invention, the insertion is accomplished by guiding elements 1. For this purpose, they can have various shapes, as shown in FIGS. 8–12. FIG. 8, for example, illustrates a guiding element 1 of standard construction, i.e., there is no special device for the insertion of fiber fleece 5. FIG. 9 illustrates a guiding element 1 with a fixed tongue 9, pushing fiber fleece 5 downwardly during the swinging motion. In FIG. 10 the tongue is shaped as a pivotal tongue 10. During the downward motion, this lies close to guiding element 1; during the upward motion it strikes on contact edge 6 of guiding element 1. FIG. 11 illustrates a guiding element 1 with staggered contact edge 11 and two guiding holes 1', and FIG. 12 illustrates a wavy contact edge 12. According to the invention, it is further possible to arrange transversely-running threads or surface configurations such as, for example, foils, webs, spun fleeces etc. between the long stitches and the fleece. It is also possible to replace the fiber fleece with layers of threads, foils or other surface configurations, with the shifting of these layers in the direction of the longitudinal axis of the needle being limited by the contact edge of the guiding element.

The apparatus according to the invention has the advantage of having bracing means, which are usually necessary when producing fleece-thread products, eliminated. In the invention, the function of the bracing pins is taken over by the contact edge of the guiding element. It is thus possible to enlarge considerably the area available for the guiding of the fleece. The visibility and accessibility of the stitching zone and the quality of the manufactured textile products can thus be markedly improved. The stretching of the fleece caused by the arrangement of the bracing pins, which occurred when the fleece entered between the knock-off plate and the supporting track, is eliminated.

Due to the fact that the most varied materials can be used as base materials, the method according to the invention can be used universally. The thread layers forming the base materials, foils and the like, are held in place until and during sewing, resulting in an improvement of the quality of the manufactured textile products.

It thus will be seen that there is provided an apparatus and a method for the production of textile surface structures which attains the various objects of the invention and which is well-adapted for the conditions of practical use. As numerous alternatives within the scope of the present invention besides these alternatives, variations, embodiments and equivalents mentioned supra, will occur to those skilled in the art, it will be understood that the present invention is to be limited only by the scope and content of the recitations in the appended claims and functional and structural equivalents thereof. In addition, it will be understood by those skilled in the art that the present invention encompasses and includes not only the present apparatus for the production of textile surface structures, but it will be appreciated that the invention also includes the present method for the production of textile surface configurations.

We claim:

1. An apparatus for producing textile surface configurations of both fleece fiber and thread, by forming stitches composed of both fiber and thread, comprising a movable guiding element, said guiding element having a contact edge on its side facing said fleece fiber, and having at least one guiding hole or eyelet for guiding said thread, together with an opposed sliding needle for forming said stitches, said sliding needle having a terminal hook portion, and means to alternately extend said sliding needle transversely through said fleece fiber in opposite directions, so that said hook portion initially engages said thread at said guiding hole or eyelet, and then, when withdrawn to the opposite side of said fleece fiber, engages and pulls both the grasped thread and grasped fibers, so as to form a combined stitch deposited as a long stitch on the side of said fleece fiber opposite to said guiding element.

2. The apparatus of claim 1, in which the guiding element is adapted to move circularly, in a compound movement relative to the longitudinal axis of the sliding needle.

3. The apparatus of claim 1 in which the guiding element has a tongue on its side facing the fiber, in order to facilitate retention of the fiber, with a minimum amount of unwanted shifting of the fiber.

4. The apparatus of claim 1 comprising a plurality of guiding elements with differently-shaped contact edges on the side of each guiding element facing the fiber, said guiding elements having differently-shaped contact edges facing the fiber being arranged next to one another.

5. The apparatus of claim 3, in which the tongue is a pivotal tongue so that the tongue pivots successively between a position in which it lies close to the guiding element during downward motion and a position in which it strikes on the contact edge during upward motion.

6. The apparatus of claim 1, in which the side of the guiding element facing the fiber is beveled, in order to facilitate retention of the fiber with a minimum amount of unwanted shifting of the fiber.

7. The apparatus of claim 1, in which the guiding element is adapted to move elliptically, in a compound movement relative to the longitudinal axis of the sliding needle.

8. The apparatus of claim 1, in which the guiding element is adapted to move rectangularly, in a compound movement relative to the longitudinal axis of the sliding needle.

9. The apparatus of claim 1, in which the guiding element is adapted to move transversely to the longitudinal axis of the sliding needle, in a compound movement relative to said axis.

10. The apparatus of claim 1, in which the side of the guiding element facing the fiber is staggered, in order to facilitate retention of the fiber with a minimum amount of unwanted shifting of the fiber.

11. The apparatus of claim 1, in which the side of the guiding element facing the fiber is divided, in order to facilitate retention of the fiber with a minimum amount of unwanted shifting of the fiber.

12. The apparatus of claim 1, in which the side of the guiding element facing the fiber is wavy, in order to facilitate retention of the fiber with a minimum amount of unwanted shifting of the fiber.

* * * * *